US009713737B2

(12) United States Patent
Chen

(10) Patent No.: US 9,713,737 B2
(45) Date of Patent: Jul. 25, 2017

(54) PEDAL MECHANISM FOR USE WITH STAIR-CLIMBER

(71) Applicant: HEALTHSTREAM TAIWAN INC., Taoyuan (TW)

(72) Inventor: Chun-Ting Chen, Taoyuan (TW)

(73) Assignee: Healthstream Taiwan Inc., Taoyuan (TW)

( * ) Notice: Subject to any disclaimer, the term of this patent is extended or adjusted under 35 U.S.C. 154(b) by 90 days.

(21) Appl. No.: 14/990,282

(22) Filed: Jan. 7, 2016

(65) Prior Publication Data

US 2017/0128766 A1 May 11, 2017

(30) Foreign Application Priority Data

Nov. 11, 2015 (TW) ..... 104137148 A

(51) Int. Cl.
*A63B 22/04* (2006.01)
*A63B 21/00* (2006.01)
*A63B 21/055* (2006.01)

(52) U.S. Cl.
CPC ..... *A63B 21/4034* (2015.10); *A63B 21/0552* (2013.01); *A63B 22/04* (2013.01)

(58) Field of Classification Search
CPC ..... A63B 22/04
See application file for complete search history.

(56) References Cited

U.S. PATENT DOCUMENTS 5,350,049 A * 9/1994 Ahls ..... B66B 23/12 198/333
8,702,571 B2 * 4/2014 Fenster ..... A63B 22/04 482/52

* cited by examiner

*Primary Examiner* — Sundhara Ganesan
*Assistant Examiner* — Rae Fischer
(74) *Attorney, Agent, or Firm* — Muncy, Geissler, Olds & Lowe, P.C.

(57) ABSTRACT

A pedal mechanism for use with a stair-climber includes a first pedal unit, a second pedal unit, a restoring unit, and a baffling board. The first pedal unit has a first pedal holder and a first pedal disposed at the first pedal holder. The second pedal unit has a second pedal holder and a second pedal disposed at the second pedal holder. The restoring unit is disposed at the first pedal holder of the first pedal unit and has a restoring element. The baffling board is movably disposed between the first pedal holder and the first pedal. The baffling board has one end connected to the restoring element and the other end pivotally connected to the second pedal. The baffling board always conceals hollowed-out regions disposed between the first and second pedals, regardless of any change in the positions of the first and second pedals relative to each other.

5 Claims, 5 Drawing Sheets

PEDAL MECHANISM FOR USE WITH STAIR-CLIMBER

BACKGROUND OF THE INVENTION

1. Technical Field

The present invention relates to stair-climbers and more particularly to a pedal mechanism for use with a stair-climber.

2. Description of Prior Art

A stair-climber works with two pedals moving cyclically so that the user simulates the action of climbing a staircase to thereby build muscle and boost cardiopulmonary fitness. To further augment the intensity of exercise, conventional stair-climbers are structurally configured to adjust their incline level. During the process of adjusting the incline level, the vertical distance between the two pedals must vary in order for the user to tread ergonomically. According to the prior art, the vertical junction between the two pedals is hollowed out. In case of an overly large vertical distance between the two pedals, the user may have one of his or her feet trapped in the hollowed-out regions. As a result, conventional stair-climbers predispose users to injuries.

SUMMARY OF THE INVENTION

It is an objective of the present invention to provide a pedal mechanism adapted for use with stair-climber and capable of enhancing user safety.

In order to achieve the above and other objectives, a pedal mechanism of the present invention comprises a first pedal unit, a second pedal unit, a baffling board, and a restoring unit. The first pedal unit has a first pedal holder and a first pedal disposed at the first pedal holder. The second pedal unit has a second pedal holder and a second pedal disposed at the second pedal holder. The second pedal unit is at a lesser height than the first pedal unit. The baffling board is movably disposed between the first pedal holder and the first pedal. The baffling board has one end pivotally connected to the second pedal, such that the baffling board is pulled by the second pedal. The restoring unit is disposed at the first pedal holder of the first pedal unit and has a restoring element. The restoring element is connected to the other end of the baffling board to exert a restoring force upon the baffling board.

In response to an increase in the vertical distance between the first and second pedals, the second pedal pulls the baffling board outward so as for the baffling board to stretch the restoring element simultaneously, thereby allowing the restoring element to accumulate a restoring force. In response to a decrease in the vertical distance between the first and second pedals, the baffling board is not only subjected to the restoring force exerted by the restoring element but also subjected to an auxiliary thrust exerted by the second pedal, so as to restore the baffling board to its initial position. Hence, the baffling board always effectively conceals hollowed-out regions disposed between the first and second pedals and thus enhances user safety, regardless of any change in the heights of the first and second pedals relative to each other.

The fine structures, features, assembly and use of the pedal mechanism provided by the present invention are illustrated with embodiments and described below. However, persons skilled in the art understand that the descriptions and the specific embodiments for illustrating and implementing the present invention are intended to explain the present invention rather than restrict the claims of the present invention.

DETAILED DESCRIPTION OF THE EMBODIMENT OF THE INVENTION

Figure 1:
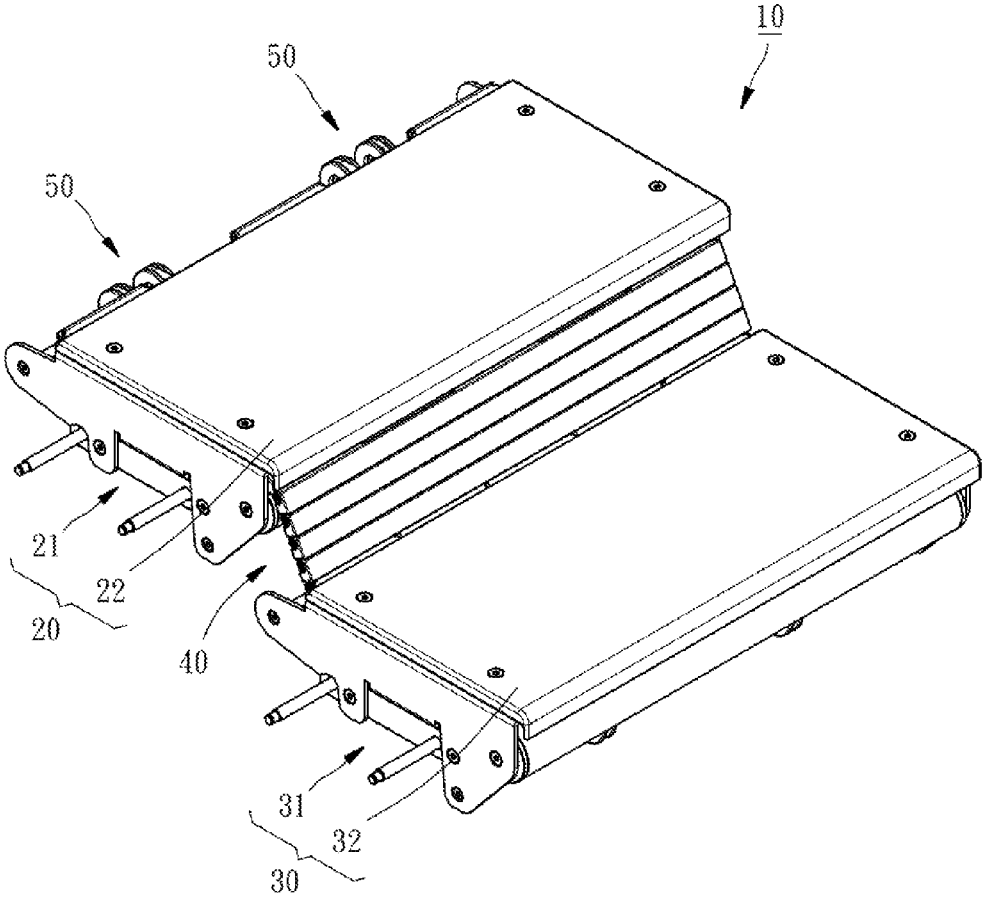
FIG. 1 is a top perspective view of a pedal mechanism of the present invention.
Figure 2:
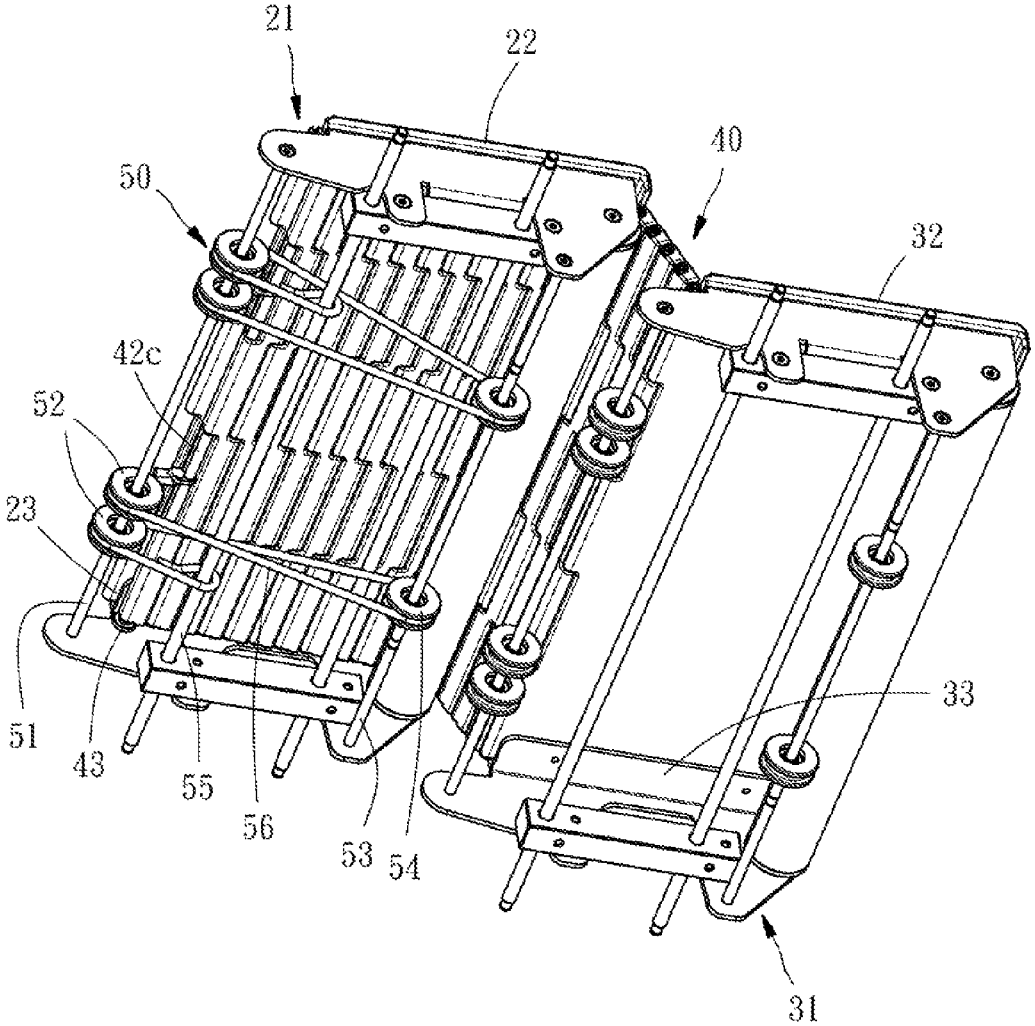
FIG. 2 is a bottom perspective view of the pedal mechanism of the present invention, showing that first and second pedals are separated by the least vertical distance.

Referring to FIG. 1, a pedal mechanism 10 of the present invention is adapted for use with a stair-climber (not shown) and provided in the plural. All the pedal mechanisms 10 are arranged one behind the other and driven jointly by a driving unit (such as a combination of a motor and a chain) to bring about cyclical motion. Considering that the pedal mechanisms 10 are structurally identical, only one of the pedal mechanisms 10 is described herein for the sake of brevity. Referring to FIG. 1 and FIG. 2, the pedal mechanism 10 of the present invention comprises a first pedal unit 20, a second pedal unit 30, a baffling board 40, and two restoring units 50.

The first pedal unit 20 has a first pedal holder 21 and a first pedal 22. Two first lateral boards 23 are disposed on two opposing sides of the first pedal holder 21, respectively. The first pedal 22 is fixed to the top surfaces of the first lateral boards 23 of the first pedal holder 21.

The second pedal unit 30 is at a lesser height than the first pedal unit 20. The vertical distance between the first pedal unit 20 and the second pedal unit 30 is adjusted with a link mechanism or an equivalent device. The second pedal unit 30 has a second pedal holder 31 and a second pedal 32. Two second lateral boards 33 are disposed on two opposing sides of the second pedal holder 31, respectively. The second pedal 32 is fixed to the top surfaces of the second lateral boards 33 of the second pedal holder 31.

Figure 3:
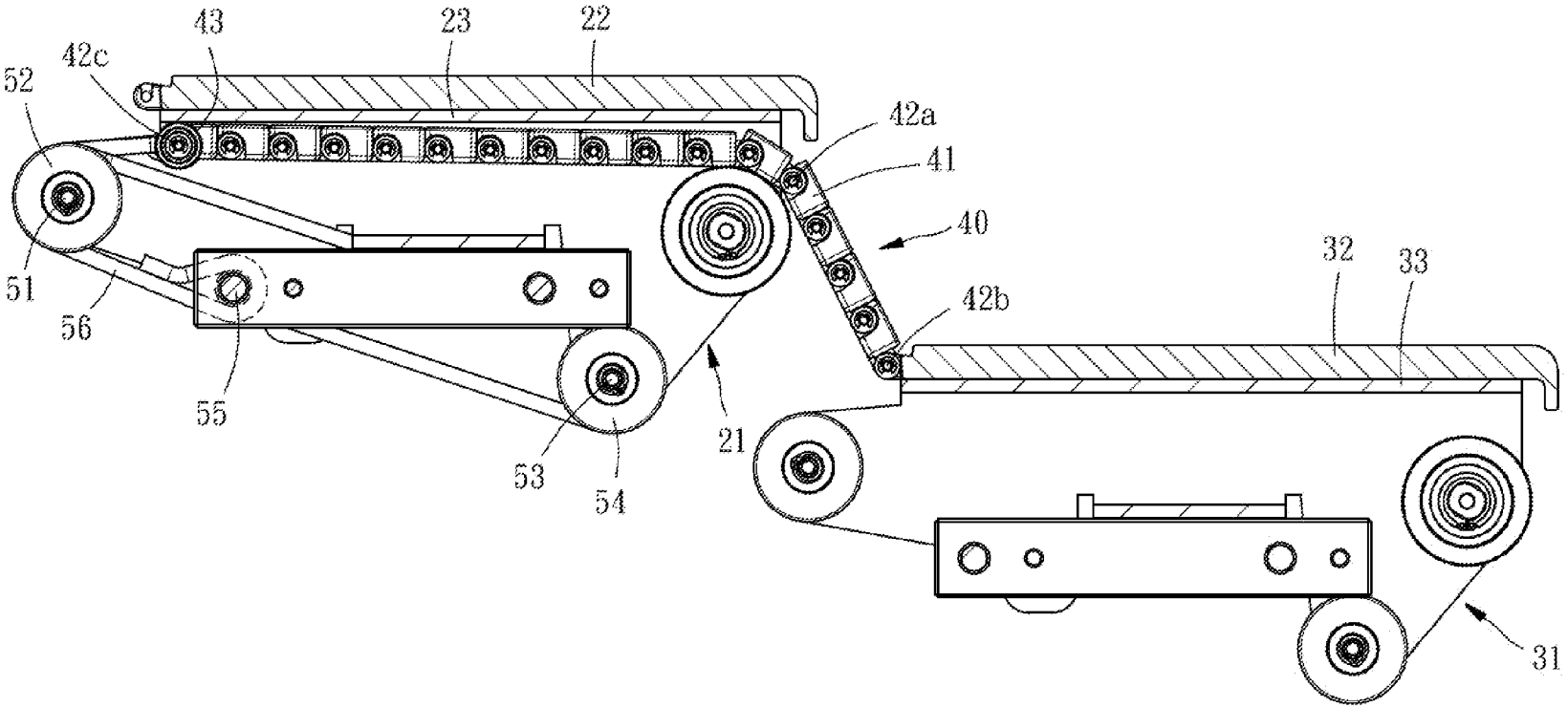
FIG. 3 is a side view of the pedal mechanism of the present invention, showing that the first and second pedals are separated by the least vertical distance.

Referring to FIG. 2 and FIG. 3, the baffling board 40 is disposed between the first pedal holder 21 and the first pedal 22. The baffling board 40 has multiple adjacent baffling plates 41 and multiple parallel baffling plate shafts 42*a*, 42*b*, 42*c*. A baffling plate shaft 42*a* is pivotally connected to and between every two adjacent baffling plates 41. The rear end of the baffling board 40 is pivotally connected to the front end of the second pedal 32 through the baffling plate shafts 42*b*, such that the baffling board 40 is pulled by the second pedal 32 to move relative to the first pedal unit 20. Two opposing limiting elements 43 are disposed at the front end of the baffling board 40. The two limiting elements 43 are mounted at two ends of the baffling plate shaft 42*c* and abut against inner lateral surfaces of the first lateral boards 23 of the first pedal holder 21, respectively, to prevent the baffling board 40 from deviating or tilting in the course of movement.

Referring to FIG. 2 and FIG. 3, the restoring units 50 each have a front idler shaft 51, two opposing front idlers 52, a rear idler shaft 53, a rear idler 54, a fixing shaft 55, and a restoring element 56. The front idler shaft 51 is disposed at the front end of the first pedal holder 21. The two front idlers 52 are disposed at one end of the front idler shaft 51. The rear idler shaft 53 is disposed at the rear end of the first pedal holder 21. The rear idler 54 is disposed at one end of the rear idler shaft 53. The fixing shaft 55 is disposed at the first pedal holder 21 and positioned between the front and rear idler shafts 51, 53. In this embodiment, the restoring element 56 is exemplified by an elastic cord, but the present invention is not limited thereto. The restoring element 56 winds around the two front idlers 52 and the rear idler 54. One end of the restoring element 56 is fixed to the baffling plate shaft 42*c* in front of the baffling board 40. The other end of the restoring element 56 is fixed to the fixing shaft 55. Hence, the restoring element 56 is stretched by the baffling board 40 as soon as the baffling board 40 is pulled by the second pedal 32.

Figure 4:
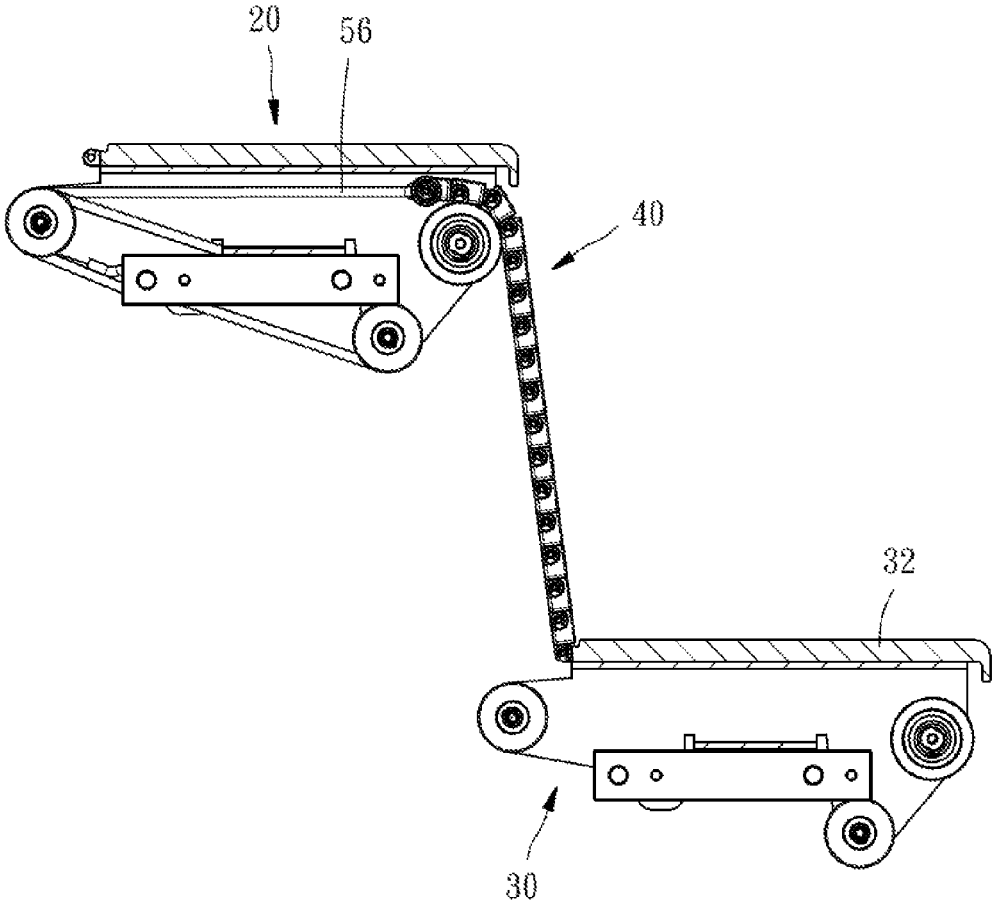
FIG. 4 is a side view of the pedal mechanism of the present invention, showing that the first and second pedals are separated by the largest vertical distance.
Figure 5:
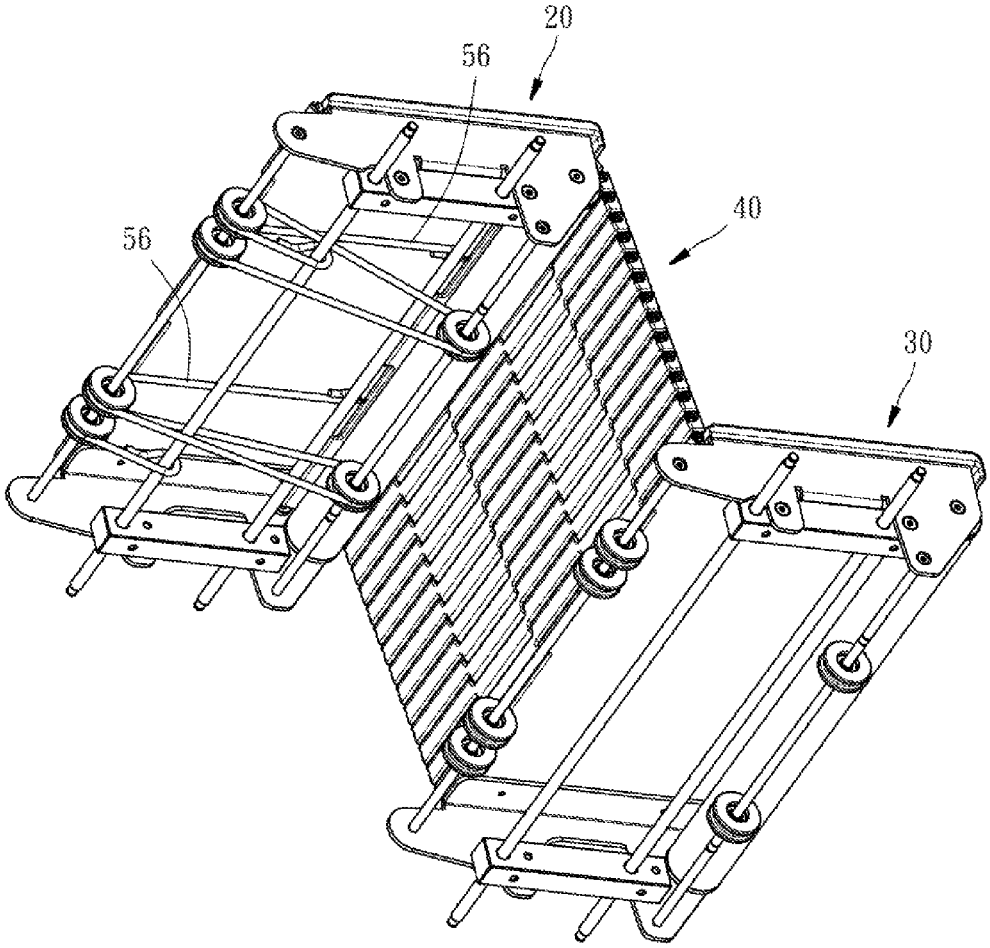
FIG. 5 is a bottom perspective view of the pedal mechanism of the present invention, showing that the first and second pedals are separated by the largest vertical distance.

Referring to FIG. 4 and FIG. 5, in response to an increase in the vertical distance between the first and second pedal units 20, 30, the second pedal 32 pulls the baffling board 40 out of the first pedal unit 20 so as for the baffling board 40 to stretch the restoring element 56 simultaneously, thereby allowing the restoring element 56 to accumulate a restoring force. Referring to FIG. 2 and FIG. 3, in response to a decrease in the vertical distance between the first and second pedal units 20, 30, the baffling board 40 is not only subjected to the restoring force exerted by the restoring element 56 but also subjected to an auxiliary thrust exerted by the second pedal 32, such that the first half of the baffling board 40 retreats into the first pedal unit 20 again. Therefore, the baffling board 40 always effectively conceals hollowed-out regions disposed between the first and second pedal units 20, 30 and thus enhances user safety, regardless of any change in the positions of the first and second pedal units 20, 30 relative to each other.

What is claimed is:

1. A pedal mechanism for use with a stair-climber, comprising:

a first pedal unit having a first pedal holder and a first pedal disposed at the first pedal holder;

a second pedal unit being at a lesser height than the first pedal unit and having a second pedal holder and a second pedal disposed at the second pedal holder;

a baffling board movably disposed between the first pedal holder and the first pedal and having an end pivotally connected to the second pedal; and a restoring unit disposed at the first pedal holder of the first pedal unit and having a restoring element connected to another end of the baffling board.

2. The pedal mechanism for use with a stair-climber according to claim 1, wherein the restoring unit has a front idler shaft, a front idler, a rear idler shaft, a rear idler, and a fixing shaft, with the front idler shaft disposed at a front end of the first pedal holder, the front idler rotatably disposed at the front idler shaft, the rear idler shaft disposed at a rear end of the first pedal holder, the rear idler rotatably disposed at the rear idler shaft, and the fixing shaft disposed at the first pedal holder and positioned between the front and rear idler shafts, wherein the restoring element is an elastic cord for winding around the front and rear idlers, and the elastic cord has an end fixed to the baffling board and another end fixed to the fixing shaft.

3. The pedal mechanism for use with a stair-climber according to claim 1, wherein the baffling board has multiple adjacent baffling plates and multiple parallel baffling plate shafts, and one said baffling plate shaft is pivotally connected to and between every two adjacent said baffling plates.

4. The pedal mechanism for use with a stair-climber according to claim 1, wherein the first pedal holder has two opposing lateral boards, and the baffling board has two opposing limiting elements abutting against inner lateral surfaces of the lateral boards, respectively.

5. The pedal mechanism for use with a stair-climber according to claim 1, wherein a vertical distance between the first and second pedal units is adjustable.

* * * * *